US008001979B2

(12) United States Patent
Yoshida et al.

(10) Patent No.: US 8,001,979 B2
(45) Date of Patent: Aug. 23, 2011

(54) SHREDDED TOBACCO AND METHOD OF TREATING TOBACCO

(75) Inventors: Shinya Yoshida, Yokohama (JP); Yoji Uwano, Yokohama (JP); Takako Moriyama, Yokohama (JP)

(73) Assignee: Japan Tobacco Inc., Tokyo (JP)

( * ) Notice: Subject to any disclaimer, the term of this patent is extended or adjusted under 35 U.S.C. 154(b) by 355 days.

(21) Appl. No.: 12/257,082

(22) Filed: Oct. 23, 2008

(65) Prior Publication Data

US 2009/0050166 A1 Feb. 26, 2009

Related U.S. Application Data

(63) Continuation of application No. PCT/JP2007/058635, filed on Apr. 20, 2007.

(30) Foreign Application Priority Data

Apr. 25, 2006 (JP) ..... 2006-121062

(51) Int. Cl.
*A24B 15/00* (2006.01)

(52) U.S. Cl. ..... 131/352; 131/297

(58) Field of Classification Search ..... None
See application file for complete search history.

(56) References Cited

U.S. PATENT DOCUMENTS

| | | | | |
|---|---|---|---|---|
| 1,954,109 | A * | 4/1934 | Whitaker | 131/352 |
| 5,025,812 | A | 6/1991 | Fagg et al. | |
| 6,298,859 | B1 | 10/2001 | Kierulff et al. | |
| 2002/0134394 | A1 | 9/2002 | Baskevitch et al. | |
| 2004/0025891 | A1 | 2/2004 | McAdam et al. | |

FOREIGN PATENT DOCUMENTS

| | | | |
|---|---|---|---|
| JP | 3-83570 | A | 4/1991 |
| JP | 2002-520005 | A | 7/2002 |
| JP | 2003-526345 | A | 9/2003 |
| JP | 2004-510422 | A | 4/2004 |
| JP | 2006-180715 | A | 7/2006 |

OTHER PUBLICATIONS

Crean, Daniel, "Cigarettes Cause Throat and Lung Cancer: You Are Being Drugged", 1952, Tobacco Control League, p. 35. Accessed via Legacy Tobacco Documents Library on Dec. 6, 2010 (Bates No. 87743566/3614) http://legacy.library.ucsf.edu/tid/nad00e00/pdf.*

* cited by examiner

*Primary Examiner* — Richard Crispino
*Assistant Examiner* — Michael J Felton
(74) *Attorney, Agent, or Firm* — Birch, Stewart, Kolasch & Birch, LLP

(57) ABSTRACT

Shredded tobacco of the invention is treated with metal iodate. A method of treating tobacco of the present invention includes adding metal iodate to shredded tobacco to decompose tobacco specific nitrosamines and polyphenols in the shredded tobacco, thereby reducing the TSNAs and polyphenols.

9 Claims, No Drawings

SHREDDED TOBACCO AND METHOD OF TREATING TOBACCO

CROSS-REFERENCE TO RELATED APPLICATIONS

This is a Continuation Application of PCT Application No. PCT/JP2007/058635, filed Apr. 20, 2007, which was published under PCT Article 21(2) in Japanese.

This application is based upon and claims the benefit of priority from prior Japanese Patent Application No. 2006-121062, filed Apr. 25, 2006, the entire contents of which are incorporated herein by reference.

BACKGROUND OF THE INVENTION

1. Field of the Invention

The present invention relates to shredded tobacco and a method of treating tobacco.

2. Description of the Related Art

Dryleaf tobacco and shredded tobacco obtained by shredding the dry leaf tobacco contain tobacco specific nitrosamines (hereinafter referred to as "TTSNAs"), which are typified by N'-nitrosonornicotine (NNN), N'-nitrosoanatabine (NAT), N'-nitrosoanabasine (NAB) and 4-(N-nitrosomethylamino)-1-(3-pyridyl)-1-butanone (NNK), and polyphenols. These TSNAs and polyphenols are substances which are desired to be removed.

Many attempts have been made to remove TSNAs and polyphenols contained in shredded tobacco. For example, Jpn. PCT National Publication No. 2003-526345 describes a method of removing nitrosamines contained in tobacco by using supercritical carbon dioxide. Also, Jpn. PCT National Publication No. 2002-520005 describes a method of removing phenolic compounds in a tobacco material by treating the tobacco material with a phenol oxidizing enzyme.

However, neither of the methods described in Jpn. PCT National Publication Nos. 2003-526345 and 2002-520005 can reduce both TSNAs and polyphenols at the same time. Also, special equipment is required in the method described in Jpn. PCT National Publication No. 2003-526345 because an operation under high pressure is necessary in this method. In the method of Jpn. PCT National Publication No. 2002-520005, an enzymatic reaction is used and it is therefore necessary to control the temperature of the system at which enzymatic activity is retained, and many steps are required for the treatment.

BRIEF SUMMARY OF THE INVENTION

It is an object of the present invention to provide shredded tobacco reduced in both TSNAs and polyphenols at the same time and also to provide a method of treating tobacco for reducing both TSNAs and polyphenols in the shredded tobacco simultaneously by a simple treating method without special equipment.

For achieving the object described above, a first aspect of the present invention provides shredded tobacco wherein the shredded tobacco is treated with metal iodate.

Also, another aspect of the present invention provides a method of treating tobacco, comprising: adding metal iodate to shredded tobacco to decompose TSNAs and polyphenols in the shredded tobacco, thereby reducing the TSNAs and polyphenols.

DETAILED DESCRIPTION OF THE INVENTION

The present invention will be described in more detail below.

The shredded tobacco of the present invention is treated with metal iodate. The method of treating tobacco according to the present invention includes adding metal iodate to shredded tobacco to decompose TSNAs and polyphenols in the shredded tobacco, thereby reducing the TSNAs and polyphenols.

As the metal iodate, alkali metal iodates are preferable. Among these alkali metal iodates, sodium iodate, lithium iodate or potassium iodate is preferable.

The amount of the metal iodate to be added to the shredded tobacco is preferably 0.5% by weight to 10% by weight with respect to the weight of the shredded tobacco.

The metal iodate is preferably added in a form of an aqueous solution. In order to add the metal iodate uniformly to the shredded tobacco, for example, an aqueous solution of the metal iodate may be added to the shredded tobacco by spraying.

In order to sufficiently decompose TSNAs and polyphenols contained in the shredded tobacco, the shredded tobacco is preferably allowed to stand for, for example, three hours or more at 20° C. to 30° C. after the metal iodate is added to the shredded tobacco. The time to allow the shredded tobacco to stand is sufficient to be two days or less.

The method of treating tobacco according to the present invention can reduce both TSNAs typified by NNN, NAT, NAB and NNK and polyphenols typified by chlorogenic acid, rutin and scopoletin in the shredded tobacco at the same time.

The metal iodate, which is a strong oxidant, decomposes TSNAs and polyphenols contained in the shredded tobacco, and therefore significantly reduces both TSNAs and polyphenols. The decomposition action on the TSNAs and polyphenols is specific to the metal iodate among metal salts of halogen acids and cannot be attained by other salts of halogen acids such as a metal chlorate or metal bromate. When metal chlorate or metal bromate is used, TSNAs tend to increase on the contrary, and polyphenols are not significantly reduced.

The shredded tobacco treated by metal iodate according to the present invention is used in, for example, cigarettes. The cigarettes can be manufactured by wrapping the shredded tobacco with cigarette paper. A filter plug can be provided at the one end of the cigarette by using chip paper.

There is a report on the fact that when burning a cigarette, TSNAs and phenols are generally contained in the generated smoke by, for example, transfer of the TSNAs and polyphenols to the smoke and thermal decomposition of the TSNAs and polyphenols (Hoffmann D., Dong M., Hecht S. S., J. Natl. Cancer Inst., 58, 1841-1844, 1977 and Carmella S., Hecht S. S., Hoffmann D., J. Agri. Food Chem. Supporting Information, 32, 267-273, 1984). According to the present invention, TSNAs and polyphenols in the shredded tobacco are reduced through decomposition and it has therefore been confirmed that TSNAs and phenols typified by hydroquinone and catechol in the cigarette smoke produced using the shredded tobacco can be reduced.

The present invention will be described by way of examples, which are not intended to limit the invention.

The component analysis for the shredded tobacco and cigarette smoke used in the examples are as follows.

A: Component Analysis for Shredded Tobacco

Polyphenols and TSNAs in the shredded tobacco were analyzed in the following manner. In the analysis, in order to improve extraction efficiency of components from the shredded tobacco, the shredded tobacco was milled with a laboratory mill to prepare a powdery sample, which was then subjected to analysis.

A1. Polyphenols 50 mL of a methanol-water mixture solution (volume ratio: 80:20) was added to 1 g of tobacco powder and the mixture was subjected to an extraction operation at 130° C. for 30 minutes in a Soxhlet extractor (manufactured by ACTAC Co., Ltd.). The extract was filtered with a 0.45 μm PTFE filter and then with a 0.20 μm PTFE filter. Then, the filtrate was analyzed with a high-performance liquid chromatograph (Agilent) to determine polyphenols.

A2. TSNAs

100 μL of an analytical internal standard solution, prepared by dissolving each of NNN and NNK substituted with deuterium in acetonitrile, was added to 250 mg of tobacco powder, and then an aqueous 0.1 M ammonium acetate solution was added to the mixture. The resulting mixture was shielded from light with an aluminum foil and was subjected to shaking extraction for 30 minutes. The extract was filtered using a 0.45 μm PTFE filter and the filtrate was analyzed with a high-performance liquid chromatograph-tandem mass spectrometer (chromatograph: manufactured by Agilent, mass spectrometer: Applied Biosystems) to determine TSNAs.

B: Component Analysis for Cigarette Smoke

Tar, nicotine and phenols in cigarette smoke were determined using a method based on the method of Health Canada. TSNAs were determined by applying the analysis method of Karl A. Wagner, etc. (55th TSRC #57, 2001).

B1. Tar and Nicotine

Smoke from two cigarettes was collected with a glass fiber filter. A variation in weight of the filter was measured to calculate the amount of crude tar per cigarette. The filter containing the crude tar was subjected to shaking extraction using 10 mL of isopropanol containing quinoline and ethanol as an analytical internal standard for 20 minutes. The obtained extract was analyzed with a gas chromatograph FID and a gas chromatograph TCD (Agilent) to determine nicotine and water. The weights of nicotine and water were subtracted from the weight of the crude tar measured in advance to calculate the tar content.

B2. Phenols

Smoke from two cigarettes was collected with a glass fiber filter. A variation in weight of the filter was measured to calculate the amount of crude tar per cigarette. The filter containing the crude tar was subjected to shaking extraction using an aqueous 1% acetic acid solution (ratio: 1 ml of a solvent/1 mg of crude tar) for 30 minutes. The obtained extract was filtered with a 0.45 μm PTFE filter. The filtrate was diluted five times with an aqueous 1% acetic acid solution. This diluted sample was analyzed with a high-performance liquid chromatograph (Agilent) to determine each of the phenols.

B3. TSNAs

Smoke from three cigarettes was collected with a glass fiber filter. The filter containing crude tar was subjected to shaking extraction using an aqueous 1 M ammonium acetate solution for 30 minutes. The obtained extract was filtered with a 0.45 μm PTFE filter and the filtrate was analyzed with a high-performance liquid chromatograph-tandem mass spectrometer (chromatograph: Agilent, mass spectrometer: Applied Biosystems) to determine each of the TSNAs.

EXAMPLES 1 to 5

To 60 g of shredded tobacco in which yellow tobacco and barley tobacco were blended in a ratio of 1:1, metal iodate (0.5% by weight of $NaIO_3$ in Example 1, see Table 1 as to Examples 2 to 5) dissolved in 24 to 48 mL of water was added by spraying in an amount of 0.5% by weight to 10% by weight with respect to the shredded tobacco. Then, the shredded tobacco was allowed to stand at 22° C. under a relative humidity of 60% for two days to prepare samples of shredded tobacco.

Component Analysis for Shredded Tobacco

The samples of Examples 2 to 5 were analyzed by using the above component analysis for the shredded tobacco to determine polyphenols and TSNAs in 1 g of the shredded tobacco. The component analysis was repeated three times to calculate an average value of the amount of each component. The average value was defined as the component value in 1 g of the shredded tobacco. Also, statistical significance of each component value relative to that in Comparative Example 1 was examined using the t-test. The results are shown in Table 1.

TABLE 1

| Component values in 1 g of shredded tobacco | | | | | | | | | |
|---|---|---|---|---|---|---|---|---|---|
| | | | Polyphenols | | | TSNAs | | | |
| | Additive | Addition amount wt % | Chlorogenic acid mg/gWB | Rutin mg/gWB | Scopoletin mg/gWB | NNN μg/gWB | NAT μg/gWB | NAB μg/gWB | NNK μg/gWB |
| Comparative Example 1 | — | — | 0.36 | 0.27 | 0.02 | 0.97 | 0.55 | 0.036 | 0.199 |
| Example 2 | $NaIO_3$ | 5.9 | ND | ND | 0.01 | *0.57 | 0.51 | 0.033 | *0.003 |
| Example 3 | $NaIO_3$ | 10 | | | | *0.48 | 0.52 | 0.033 | *0.003 |
| Example 4 | $LiIO_3$ | 5.4 | ND | ND | 0.01 | *0.61 | *0.44 | 0.030 | *0.031 |
| Example 5 | $KIO_3$ | 6.4 | ND | ND | 0.01 | *0.80 | 0.52 | 0.032 | *0.046 |
| Comparative Example 2 | $NaClO_3$ | 3.2 | 0.43 | 0.30 | 0.02 | | | | |
| Comparative Example 3 | $NaBrO_3$ | 4.5 | 0.41 | 0.23 | 0.02 | | | | |

*There is a significance in the t-test.

WB: Wet base

ND: Below detection limit

COMPARATIVE EXAMPLE 1

Each component value in the shredded tobacco was determined in the same method and analysis as in Examples 1 to 5 except that only 24 ml of water was added by spraying in place of the aqueous metal iodate solution. The results are shown together in Table 1 collectively.

COMPARATIVE EXAMPLES 2 and 3

The content of each component in 1 g of the shredded tobacco was determined in the same method and analysis as in Examples 1 to 5 except that metal chlorate in an amount of 3.16% by weight or a metal bromate in an amount of 4.48% by weight with respect to the weight of the shredded tobacco was used, to examine statistical significance. The results are shown together in Table 1 collectively.

As shown in Table 1 it was found that in Examples 2 to 5, polyphenols in the shredded tobacco were reduced to below the detection limit due to addition of metal iodate to the shredded tobacco. Also, it was also found that TSNAs in the shredded tobacco were reduced. It was found from the results of Comparative Examples 2 and 3 that when salts of halogen acids other than iodate were used as the oxidant, no reduction in polyphenols was observed.

Cigarettes

Using each of the shredded tobacco prepared in Examples 1 to 5 and Comparative Examples 1 to 3, single wrap cigarettes having a length of 59 mm and a circumferential length of 25 mm were manufactured by using a small paper-making machine (RIZLA UK Ltd.). A 25-mm-long filter with tip paper was joined with the single wrap cigarette and the filter tow was removed with forceps to prepare a cigarette sample. Loading amount of the shredded tobacco per cigarette (mg/cig) was determined according to the following formula corresponding to an addition amount of the salt of halogen acid (wt %).

Loading amount of shredded tobacco per cigarette [mg/cig.]=650×(100+addition amount of the salt of halogen acid (wt %))/100)

Specifically, when 10% by weight of the salt of halogen acid is added, the shredded tobacco is loaded in an amount of 715 mg per cigarette, whereas when the salt of halogen acid is not added, the shredded tobacco is loaded in an amount of 650 mg per cigarette. The loading amount of each of the shredded tobacco per cigarette is shown in the following Table 2.

The prepared cigarette samples were burned according to the standard smoking condition prescribed in ISO. Specifically, an automatic smoking machine was used to smoke the cigarette under the following conditions: puff volume: 35 ml per puff, puff duration: 2 seconds per puff, puff frequency: a puff per one minute, and butt length: 35 nm (including the tip paper).

The smoke of the burned cigarette sample was analyzed using the above component analysis for cigarette smoke. The component analysis was repeated three times and an average value of the amount of each component was calculated per cigarette. The average value was defined as the component value in the cigarette smoke per cigarette. Also, statistical significance of each component value relative to the cigarette loaded with the shredded tobacco of Comparative Example 1, to which no additive was added, was examined using the t-test. The results are shown in Table 2.

TABLE 2

Loading amount of shredded tobacco and component values in tobacco smoke per cigarette

| Shredded tobacco | Loading amount of shredded tobacco mg/cig | Tar mg/cig | Nicotine mg/cig | Hydro-quinone μg/cig | Catechol μg/cig | NNN ng/cig | NAT ng/cig | NAB ng/cig | NNK ng/cig | Number of puffs number |
|---|---|---|---|---|---|---|---|---|---|---|
| Comparative Example 1 | 650 | 24.01 | 1.82 | 134.23 | 81.99 | 75.78 | 76.47 | 11.67 | 52.69 | 7.88 |
| Example 1 | 653 | 26.04 | 1.76 | 130.36 | 89.00 | *66.29 | 69.47 | *8.98 | *38.96 | 7.68 |
| Example 2 | 688 | *28.18 | *1.46 | *94.63 | *64.89 | *49.91 | 60.69 | *7.51 | *26.56 | 7.71 |
| Example 3 | 715 | *28.35 | *1.18 | *95.39 | *63.63 | *46.98 | 66.11 | *7.03 | *27.33 | 7.85 |
| Example 4 | 685 | *34.21 | *1.45 | *67.48 | *70.18 | *49.78 | 56.78 | *6.87 | *15.60 | 7.80 |
| Example 5 | 691 | *30.76 | *1.40 | *93.74 | *64.65 | *46.27 | 52.53 | *4.54 | *17.87 | 7.51 |
| Comparative Example 2 | 671 | 26.89 | 1.64 | 117.41 | 82.76 | 79.78 | 83.78 | 13.89 | 49.93 | 6.88 |
| Comparative Example 3 | 679 | 27.20 | 1.62 | 103.37 | 80.28 | 106.44 | 115.33 | 19.18 | 45.76 | 7.17 |

*There is a significance in the t-test.

As shown in Table 2, in the cigarettes loaded with the shredded tobacco treated with metal iodate, almost all phenols and TSNAs in the smoke were reduced with a statistical significance of 95% or more compared with the cigarette loaded with the shredded tobacco of Comparative Example 1. In particular, NNK among TSNAs was reduced up to about 50% at maximum. In the cigarette loaded with the shredded tobacco treated with metal salts of halogen acids other than the metal iodate, TSNAs tended to increase and phenols was not significantly reduced compared to those components in the smoke from the cigarette loaded with the shredded tobacco of Comparative Example 1.

Further advantages and modifications of the present invention are obvious to a person having an ordinary skill in the art. The present invention is therefore not limited to the specified descriptions and typical embodiments described here in its broader aspect. Various modifications are therefore possible without departing from the spirit and scope of the overall concept of the present invention defined by the appended claims and their equivalents.

What is claimed is:

1. Shredded tobacco, wherein the shredded tobacco is treated with 0.5% by weight to 10% by weight of metal iodate with respect to a weight of the shredded tobacco.

2. The shredded tobacco according to claim 1, wherein the metal iodate is an alkali metal iodate.

3. The shredded tobacco according to claim 1, wherein the metal iodate is sodium iodate, lithium iodate or potassium iodate.

4. The shredded tobacco according to claim 1, wherein the metal iodate is in a form of an aqueous solution.

5. A cigarette comprising the shredded tobacco according to claim 1.

6. A method of treating tobacco, comprising:

adding metal iodate to shredded tobacco in an amount of 0.5% by weight to 10% by weight of the metal iodate with respect to a weight of the shredded tobacco in order to decompose tobacco specific nitrosamines and polyphenols in the shredded tobacco, thereby reducing the tobacco specific nitrosamine and polyphenol content of the tobacco.

7. The method according to claim 6, wherein the metal iodate is an alkali metal iodate.

8. The method according to claim 6, wherein the metal iodate is sodium iodate, lithium iodate or potassium iodate.

9. The method according to claim 6, wherein the metal iodate is in a form of an aqueous solution.

* * * * *